US007228843B2

(12) United States Patent
Osburg et al.

(10) Patent No.: US 7,228,843 B2
(45) Date of Patent: Jun. 12, 2007

(54) INTERNAL COMBUSTION ENGINE HAVING A CARBURETOR AND A STARTING DEVICE

(75) Inventors: Gerhard Osburg, Kernen (DE); Wolfgang Luithardt, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 624 days.

(21) Appl. No.: 10/664,155

(22) Filed: Sep. 17, 2003

(65) Prior Publication Data

US 2005/0166897 A1 Aug. 4, 2005

(30) Foreign Application Priority Data

Sep. 18, 2002 (DE) ..... 102 43 167

(51) Int. Cl.
*F02M 1/14* (2006.01)

(52) U.S. Cl. ..... 123/435; 123/179.4

(58) Field of Classification Search ..... 123/182.1, 123/435, 179.14, 179.16, 179.18, 585
See application file for complete search history.

(56) References Cited

U.S. PATENT DOCUMENTS 5,740,781 A * 4/1998 Scott et al. ..... 123/437
6,505,616 B2 * 1/2003 Hehnke ..... 123/588
6,585,235 B2 * 7/2003 Pattullo ..... 261/44.8
6,932,058 B2 * 8/2005 Nickel et al. ..... 123/438
2001/0007251 A1 * 7/2001 Hehnke ..... 123/588

FOREIGN PATENT DOCUMENTS

JP 62060971 3/1987

* cited by examiner

*Primary Examiner*—Stephen K. Cronin
*Assistant Examiner*—Arnold Castro
(74) *Attorney, Agent, or Firm*—Walter Ottesen

(57) ABSTRACT

A two-stroke engine has an intake channel via which the engine (1) is supplied with an air/fuel mixture prepared in a carburetor (12). The engine also has a starting device (19, 40) for enrichment of the air/fuel mixture during the start operation. The starting device (19, 40) is disposed in the region of the carburetor (12). To avoid an overenrichment of the mixture after start-up of the engine, a bypass channel (20) is provided which branches off upstream of the starting device (19, 40) viewed in the flow direction (30) of the air/fuel mixture and opens downstream of the starting device (19, 40). A switching valve (23) is mounted in the bypass channel (20) and is essentially closed when the engine (1) is started. When the engine (1) runs up, the switching valve (23) automatically switches into a position where less throttling occurs.

8 Claims, 2 Drawing Sheets

INTERNAL COMBUSTION ENGINE HAVING A CARBURETOR AND A STARTING DEVICE

BACKGROUND OF THE INVENTION

To crank start an internal combustion engine, especially a two-stroke engine, the mixture must be enriched. For this purpose, a great many systems are known. Accordingly, a choke flap is mounted in a carburetor upstream of a throttle flap in order to increase the underpressure during crank strokes so that an intense pumping of fuel is effected and thereby the mixture is made rich. In starting devices of this kind, it is problematic that the operator must timely at least partially take the choke flap out of use during run-up of the engine so that an overrich engine and therefore a stalling of the engine associated therewith is avoided.

Japanese patent publication 62060971 discloses that the choke flap of a carburetor automatically opens with the run-up of the engine. For this purpose, the underpressure increasing in the intake channel is used. It has, however, been shown that a system of this kind works too slowly so that a stalling of the engine because of overenrichment can still not be precluded.

SUMMARY OF THE INVENTION

It is an object of the invention to provide an internal combustion engine having a starting device with which an overenrichment of the mixture is reliably avoided during the run-up of the engine.

The internal combustion engine of the invention includes a two-stroke engine and the internal combustion engine includes: an intake channel to which an air/fuel mixture is supplied in a flow direction; a carburetor for preparing the air/fuel mixture; a starting device configured in the region of the carburetor to enrich the air/fuel mixture during a starting operation of the engine; a bypass channel having a first end branching off upstream of the starting device viewed in the flow direction and having a second end opening downstream of the starting device; and, a switching valve mounted in the bypass channel and being movable from a position wherein the switching valve is essentially closed for starting the engine and, when the engine runs up, the switching valve being movable automatically into a less throttling position.

With the switchable bypass channel, it is ensured that an additional air path is enabled simultaneously with the run-up of the engine. This air path moves bypass air into the intake channel so that an overenrichment of the inducted air/fuel mixture is reliably avoided. The rapid switching of the bypass channel is achieved via a switching valve which is closed for starting the engine and, with the run-up of the engine, the switching valve switches automatically into a less throttling position so that the mixture is made lean and a continued running of the engine is ensured. Advantageously, the switching valve for opening the bypass channel is actuated by the combustion pressure in the combustion chamber of the engine because, with occurring combustion pressure, an ignition has taken place and the engine starts to run. It is especially practical to integrate the switching valve for the bypass channel into a decompression valve or to actuate the valve element of the switching valve by the switching element of the decompression valve.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
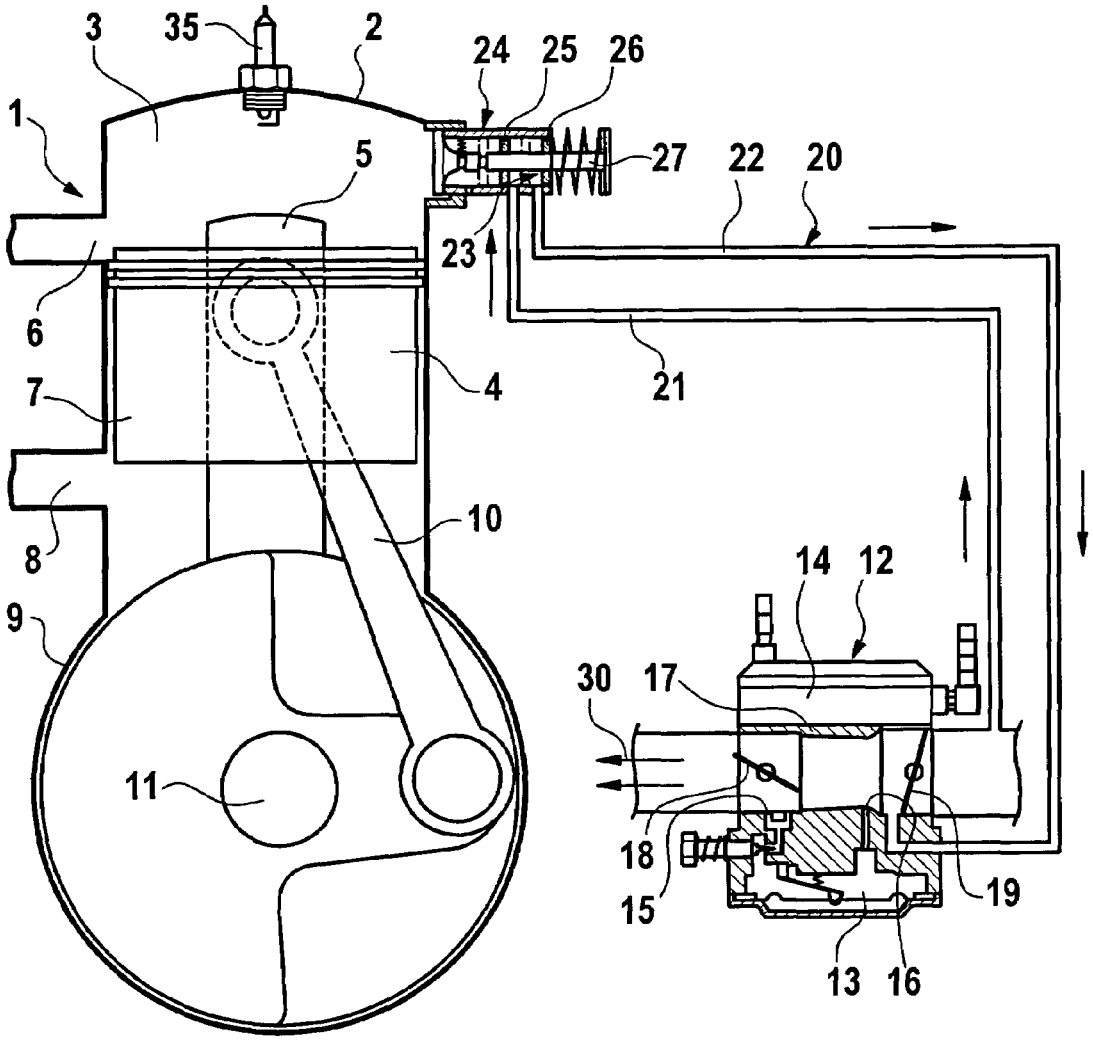
FIG. 1 is a schematic of a two-stroke engine having a carburetor and a starting device.

The internal combustion engine 1 shown in FIG. 1 is a two-stroke engine having a cylinder 2. The combustion chamber 3 of the cylinder is delimited by the piston 4. The piston 4 controls a transfer window 5 as well as an outlet window 6 of the combustion chamber 3. The skirt 7 of the piston controls a mixture inlet 8 in the crankcase 9. The piston 4 drives a crankshaft 11 via a connecting rod 10. The crankshaft 11 is rotatably journalled in the crankcase 9.

The air/fuel mixture, which is necessary for operation, is prepared in a mixture preparation unit which, in the embodiment shown, is a carburetor 12. The carburetor shown in FIG. 1 is a membrane carburetor having a fuel-filled control chamber 13 which is supplied with fuel via an inlet valve (not shown) from a fuel pump 14. The control chamber 13 is connected to an intake channel section 17, which is configured as a venturi, via idle nozzles 15 and a main nozzle 16. In the region of the idle nozzles 15, a rotatably journalled throttle flap 18 is provided. A starting device in the form of a choke flap 19 is mounted upstream of the intake channel section 17.

According to a feature of the invention, a bypass channel 20 is provided which includes two line sections 21 and 22. Referred to the flow direction 30 of the air/fuel mixture, the section 21 branches off upstream of the choke flap 19 and the second line section 22 opens into the intake channel section 17 downstream of the choke flap 19. The line sections 21 and 22 are connected to each other by a switching valve 23 which is actuated when starting the engine. Preferably, the switching valve 23 is actuated by the combustion pressure in the combustion chamber 3 of the engine 1. In a special embodiment, the valve member 26 of the valve 23 is actuated by the switching element 27 of a decompression valve 24. The switching valve 23 is preferably integrated into the decompression valve 24. A seal (25, 36) separates the valve space 32 of the switching valve 23 from the interior space of the decompression valve 24 or from the ambient.

Figure 2:
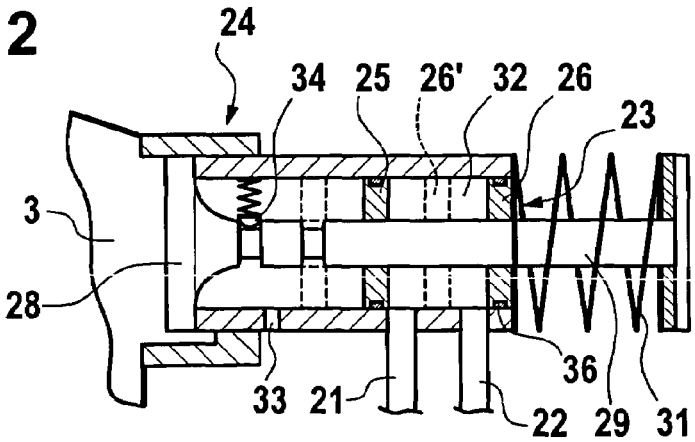
FIG. 2 is an enlarged view in schematic section through the decompression valve shown in FIG. 1; and, FIG. 3 is a schematic of another embodiment of a two-stroke engine having a carburetor and a starting device.

As shown in the enlarged view of FIG. 2, the decompression valve 24 comprises a valve member configured similarly to a valve plate 28 and this valve member is held so as to be displaceable via a valve shaft 29. The valve shaft 29 is resiliently biased by a spring 31 in the closed position of the valve plate 28.

The valve member 26 of the switching valve 23 is mounted on the valve shaft 29. In the open position shown in FIG. 2, the valve member 26 lies outside of the openings of the two line sections 21 and 22 so that these line sections are connected to each other via the valve space 32.

For starting, the decompression valve 24 is switched by depressing the valve shaft 29 into the open position so that the valve plate 28 is lifted from the valve seat and the combustion chamber is connected via a decompression opening 33 to the atmosphere. In this open position, the valve shaft 29 is latched via a spring-biased latch device 34.

In this start position of the decompression valve 24, the valve member 26 lies in the position 26' shown in phantom outline in FIG. 2 whereby the line sections 21 and 22 are separated from each other and no air can flow through the bypass channel 20. Downstream of the choke flap 19, a high underpressure therefore builds up which leads to an intense movement of fuel through the idle nozzles 15 and the main nozzle 16. The mixture is enriched for starting.

Most internal combustion engines 1 are manually crank started, for example, via a pull-rope starter or the like which engages the crankshaft 11. The start is facilitated because of the switched decompression valve 24. As soon as an ignition is triggered via the spark plug 35, the pressure in the combustion chamber 3 increases tremendously and acts on the valve plate 28 so that the latch device 34 releases because of the pressure force and the decompression valve 24, supported by the force of the spring 31, switches into the closed position shown in FIG. 2. The running-up engine draws more mixture through the inlet 8 with increasing rpm and, for this reason, the underpressure in the intake section 17 increases. With the closing of the decompression valve 24, the valve member 26 is simultaneously transferred into the open position of FIG. 2. For this reason, when the engine 1 starts to run, the bypass channel 20 switches into a less throttled position, especially into an open position. The starter device 19 is bypassed via the line section 21, the valve space 32 and the line section 22. The pressure in the intake channel section 17 drops so that overenrichment of the mixture is avoided. The mixture leans because of the additional air supplied via the bypass 20 and the engine continues to run.

Figure 3:
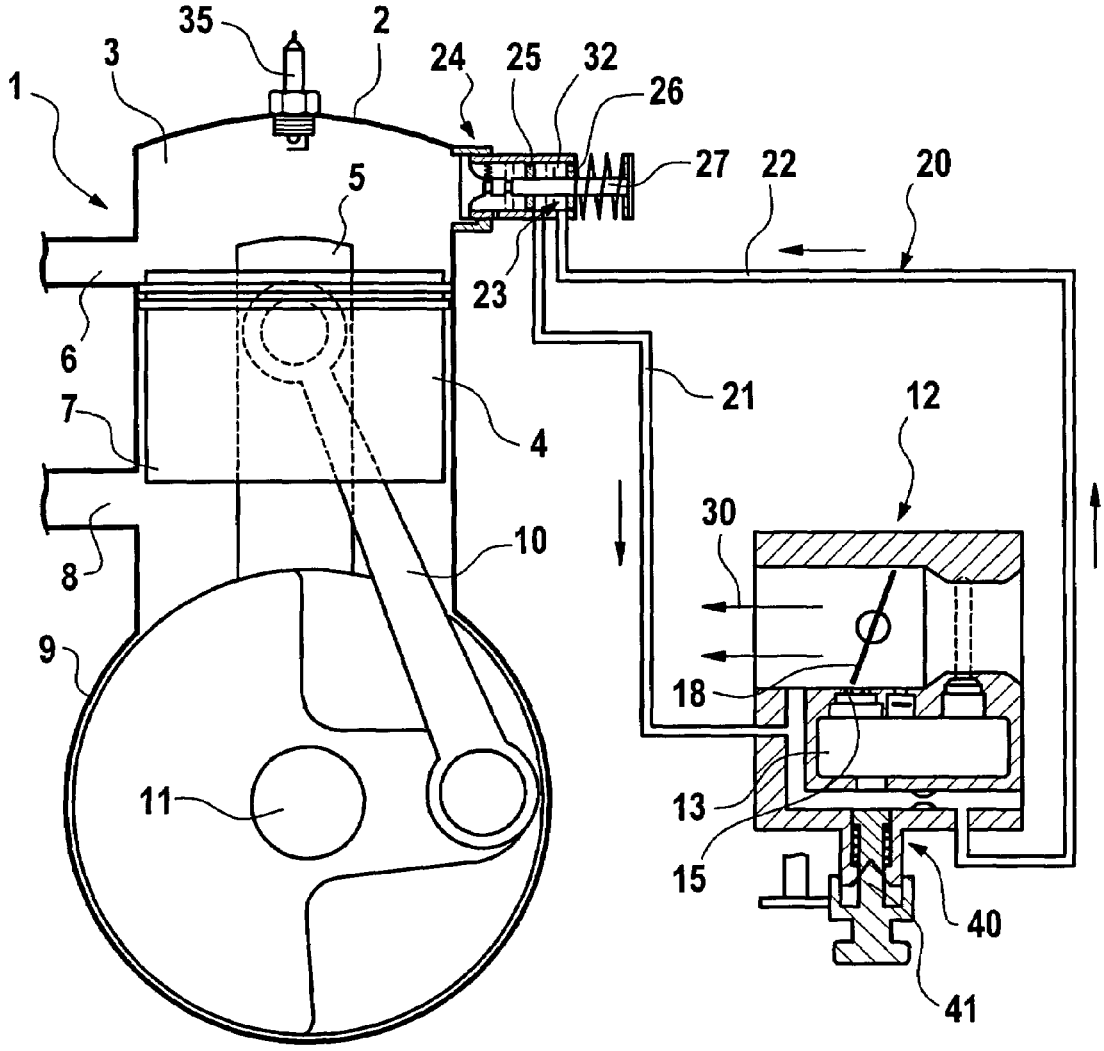

The embodiment of FIG. 3 corresponds to the embodiment of FIG. 1 and, for this reason, the same parts are identified by the same reference numerals. In lieu of a choke flap 19 as a starter device, the carburetor 12 includes an ancillary carburetor 40 which is configured parallel to the intake channel section 17 and bypasses the throttle flap. The ancillary carburetor 40 is switched in and out via a check member 41 and moves more fuel into the intake channel section 17 in the start position of the throttle flap so that an enriched air/fuel mixture 30 is supplied to the engine. The decompression valve 24 as well as the switching valve 23 is configured as described with respect to FIG. 1. The valve member 26 lies in the position 26' of FIG. 2 when the decompression valve 24 is pressed and therefore open and locks the line sections 21 and 22. When the engine 1 runs up, the decompression valve is automatically closed by the compression chamber pressure and simultaneously actuates the switching valve 23 which lies in its open position when the decompression valve 24 is closed. The line sections 21 and 22 are flow connected to each other via the valve space 32 so that upstream of the ancillary carburetor 40, air flows through the line section 22, the valve space 32 and the line section 21 and opens downstream of the ancillary carburetor 40 into the flow path thereof, that is, into the intake channel section 17. When starting the engine, the bypass channel 20 is opened when the engine runs up so that more air is supplied downstream of the throttle flap 18 whereby the mixture is leaned. An overenrichment is therefore reliably avoided and the engine remains running.

It is understood that the foregoing description is that of the preferred embodiments of the invention and that various changes and modifications may be made thereto without departing from the spirit and scope of the invention as defined in the appended claims.

What is claimed is:

1. An internal combustion engine including a two-stroke engine and said internal combustion engine comprising:

an intake channel to which an air/fuel mixture is supplied in a flow direction;

a carburetor for preparing said air/fuel mixture;

a starting device configured in the region of said carburetor to enrich said air/fuel mixture during a starting operation of said engine;

a bypass channel having a first end branching off upstream of said starting device viewed in said flow direction and having a second end opening downstream of said starting device;

a switching valve mounted in said bypass channel and being movable from a position wherein said switching valve is essentially closed for starting said engine and, when said engine runs up, said switching valve being movable automatically into a less throttling position; and, said switching valve being actuated by the compression pressure in the combustion chamber of said engine.

2. The internal combustion engine of claim 1, wherein said essentially closed position is a block position for starting said engine and the less throttling position is an open position when the engine has run up.

3. The engine of claim 1, wherein said carburetor has a venturi section and said starting device is a choke flap mounted upstream of said venturi section.

4. The engine of claim 1, wherein said engine includes a decompression valve and said switching valve has a valve member actuated by said decompression valve.

5. The engine of claim 4, wherein said decompression valve has a housing and said valve member is integrated into said housing.

6. An internal combustion engine including a two-stroke engine and said internal combustion engine comprising:

an intake channel which an air/fuel mixture is supplied in a flow direction;

a carburetor for preparing said air/fuel mixture;

a starting device configured in the region of said carburetor to enrich said air/fuel mixture during a starting operation of said engine;

a bypass channel having a first end branching off upstream of said starting device viewed in said flow direction and having a second end opening downstream of said starting device;

a switching valve mounted in said bypass channel and being movable from a position wherein said switching valve is essentially closed for starting said engine and, when said engine runs up, said switching valve being movable automatically into a less throttling position; and, said carburetor defining a main carburetor path and said starting device being an ancillary carburetor configured parallel to said main carburetor path.

7. The internal combustion engine of claim 6, wherein said essentially closed position is a block position for starting said engine and the less throttling position is an open position when the engine has run up.

8. The internal combustion engine of claim 6, wherein said carburetor has a venturi section and said starting device is a choke flap mounted upstream of said venturi section.

* * * * *

UNITED STATES PATENT AND TRADEMARK OFFICE

CERTIFICATE OF CORRECTION

PATENT NO. : 7,228,843 B2
APPLICATION NO. : 10/664155
DATED : June 12, 2007
INVENTOR(S) : Gerhard Osburg and Wolfgang Luithardt It is certified that error appears in the above-identified patent and that said Letters Patent is hereby corrected as shown below:

In column 4:
Line 37: insert -- to -- after "channel".

Signed and Sealed this

Seventh Day of August, 2007

JON W. DUDAS
*Director of the United States Patent and Trademark Office*